US007273107B2

(12) United States Patent
Hiron et al.

(10) Patent No.: US 7,273,107 B2
(45) Date of Patent: Sep. 25, 2007

(54) VALVE WITHIN A CONTROL LINE

(75) Inventors: Stephane Hiron, Houston, TX (US); Rodney J. Wetzel, Katy, TX (US); Philippe Gambier, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 218 days.

(21) Appl. No.: 10/709,972

(22) Filed: Jun. 10, 2004

(65) Prior Publication Data

US 2005/0274528 A1 Dec. 15, 2005

(51) Int. Cl.
*E21B 33/37* (2006.01)

(52) U.S. Cl. ..... 166/373; 166/375

(58) Field of Classification Search ..... 166/373, 166/375

See application file for complete search history.

(56) References Cited

U.S. PATENT DOCUMENTS

| | | | | |
|---|---|---|---|---|
| 4,193,449 | A | 3/1980 | Lochte et al. | |
| 4,202,368 | A | 5/1980 | Akkerman | |
| 4,846,272 | A | 7/1989 | Leggett | |
| 6,450,263 | B1 * | 9/2002 | Schwendemann | 166/373 |
| 6,536,530 | B2 * | 3/2003 | Schultz et al. | 166/375 |
| 6,595,296 | B1 * | 7/2003 | French | 166/375 |
| 6,659,184 | B1 | 12/2003 | Tips et al. | |

* cited by examiner

*Primary Examiner*—William Neuder
*Assistant Examiner*—Nicole Coy
(74) *Attorney, Agent, or Firm*—Van Someren, PC; Dana C. Edwards; Bryan P. Galloway

(57) ABSTRACT

The invention is a valve that prevents blow-outs through a control line while simultaneously allowing bi-directional flow or pressure transfer through the control line. The invention comprises a shuttle valve disposed in the control line.

14 Claims, 5 Drawing Sheets

VALVE WITHIN A CONTROL LINE

BACKGROUND OF INVENTION

The invention generally relates to a valve within a downhole control line. More specifically, the invention relates to a valve within a downhole control line, which valve is adapted to prevent blow-outs through the control line while simultaneously allowing bi-directional flow or pressure transfer through the control line.

A hydraulic control line is typically used in subterranean wellbores to control a downhole tool. Increases of pressure, decreases of pressure, and/or pressure fluctuations within the control line direct the tool to perform certain functions. For instance, an increase in pressure can move a sleeve valve from a first, open position to a second, closed position. In turn, a subsequent decrease in pressure can enable the movement of the sleeve valve back to its first, open position. Hydraulic control lines can also be used to control other types of valves (such as ball valves, disc valves, etc.), packers, and perforating guns, among others.

Since hydraulic control lines extend from downhole to the surface, they provide a flow path independent of the production tubing or wellbore. If a blow-out occurs in the wellbore, sealing the blow-out within the wellbore and production tubing may still allow the blow-out to pass through the control line, since the control line is an independent flow path. Therefore, to truly control blow-outs in wellbores with hydraulic control lines, a mechanism must be in place to seal off the control line as well as the wellbore/production tubing in case of a blow-out.

Typically, a one-way check valve, such as a spring-ball arrangement, is included in the control line. The check valve enables flow in the downhole direction, but does not allow flow in the uphole direction thereby preventing blow-outs. However, depending on the control line and downhole tool system, it may be necessary to enable flow in both directions within the control line while simultaneously preventing blow-outs through the control line.

Thus, there is a continuing need to address one or more of the problems stated above.

SUMMARY OF INVENTION

The invention is a valve that prevents blow-outs through a control line while simultaneously allowing bi-directional flow or pressure transfer through the control line. The invention comprises a shuttle valve disposed in the control line.

Advantages and other features of the invention will become apparent from the following drawing, description and claims.

DETAILED DESCRIPTION

In the present invention, a hydraulic control line 20 is disposed adjacent a tubing 22, such as production tubing. The control line 20 is typically attached to the tubing 22 by way of clamps (not shown).

A valve 30 is functionally connected to the control line 20. The valve 30 is adapted to enable pressure transfer (including flow) in both the downhole and uphole directions and to seal off blow-outs if one should occur. In one embodiment, valve 30 comprises a shuttle valve 30. While the description and drawings reference a shuttle valve, it is understood that valve 30 may comprise another type of valve provided that such valve is adapted to enable flow or pressure transfer in both the downhole and uphole directions and to seal off blow-outs if one should occur.

Figure 1:
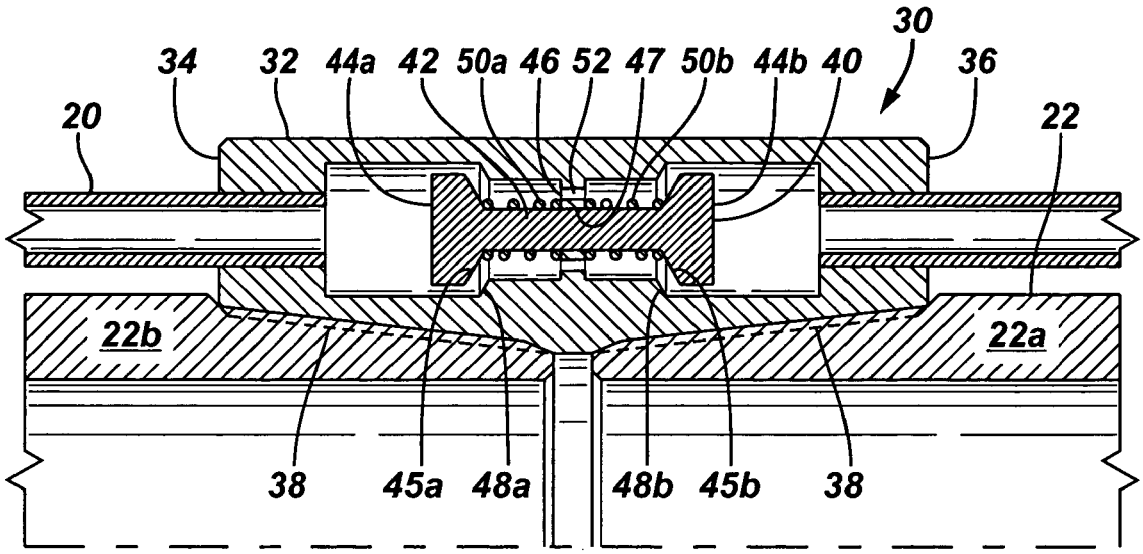
FIG. 1 is an illustration of one embodiment of the shuttle valve.

In the embodiment illustrated in FIG. 1, a shuttle valve 30 is located in a housing 32 that is in fluid communication on both housing ends 34, 36 with the control line 20. The housing 30 can be annular in shape such that it also acts as a joint between two tubing pieces 22*a*, 22*b*. The joint housing 32 includes threads 38 enabling it to connect the two tubing pieces 22*a*, 22*b* together (each of which also have threaded ends). The control line 20 can be attached to each housing end 34, 36 by way of threads or clamps (not shown).

In another embodiment (not shown), the shuttle valve 30 is located directly within the control line 20.

A shuttle 40 is located within the housing 32 and includes a rod portion 42 and two end portions 44. The rod portion 42 is slidingly disposed within a constriction 46 in the housing 32. In one embodiment, the constriction 46 is annular in shape and the shuttle 40 is slidingly disposed within an orifice 47 disposed in the constriction 46. The shuttle 40 can slide in both directions between a first position, in which one of the end portions 44*a* is in abutment with a housing surface 48*a*, and a second position, in which the other of the end portions 44*b* is in abutment with a housing surface 48*b*. The sliding motion between the first and second positions is biased by two springs 50*a*, 50*b*. One spring 50*a* is disposed between one side of the constriction 46 and one of the end portions 44*a* thereby providing a counter-force to the movement of the shuttle 40 in the direction of the end portion 44*b*. The other spring 50*b* is disposed between the other side of the constriction 46 and the other end portion 44*b* thereby providing a counter-force to the movement of the shuttle 40 in the direction of the end portion 44*a*.

In one embodiment, the housing surface 48*a* and the surface 45*a* on end portion 44*a* that abuts the housing surface 48*a* are constructed so that a metal-to-metal seal is created therebetween (such as by mating profiles as shown) when the shuttle valve 30 is in the first position. Also, the housing surface 48*b* and the surface 45*b* on end portion 44*b* that abuts the housing surface 48*b* are constructed so that a metal-to-metal seal is created therebetween (such as by mating profiles as shown) when the shuttle valve 30 is in the second position.

Constrictor 46 includes at least one opening 52 for allowing fluid flow therethrough. In one embodiment, the constrictor 46 includes a plurality of openings 52. In one embodiment, the openings 52 are located on constrictor 46 radially outward from orifice 47.

In operation and assuming that end portion 44*b* is proximate the uphole direction and end portion 44*a* is proximate the downhole direction (although the shuttle valve 30 can function if the opposite is true), an operator may wish to use control line 20 to communicate with a tool downhole. In so doing, the operator may pressurize the control line 20 from the surface. As long as the pressure from the surface does not overcome the counter-force provided by spring 50*b*, the fluid disposed in the control line 20 will flow around the end portion 44*b*, through the openings 52 in the constrictor 46, around the end portion 44*a*, and to the downhole location of the tool. Subsequently, or instead of pressuring the control line 20, an operator may cause fluid flow to reverse within control line 20 so that fluid flows from the downhole location to the surface. As long as the pressure from the downhole location does not overcome the counter-force provided by spring 50*a*, the fluid disposed in the control line 20 will flow around the end portion 44*a*, through the openings 52 in the constrictor 46, around the end portion 44*b*, and to the surface.

If there is a blow-out downhole or if there is a pressure spike from the downhole location and such blow-out or pressure spike is transmitted through the control line 20, then such increased pressure overcomes the counter-force provided by the spring 50*b* and moves the shuttle valve 30 to the first position wherein a metal-to-metal seal is created between the end portion surface 45*a* and the housing surface 48*a*. Conversely, if for any reason there is a pressure spike from the surface through the control line 20, then such increased pressure overcomes the counter-force provided by the spring 50*a* and moves the shuttle valve 30 to the second position wherein a metal-to-metal seal is created between the end portion surface 45*b* and the housing surface 48*b*.

Thus, in the first and second positions, fluid communication is interrupted across shuttle 40. It is understood that depending on the flow direction the shuttle 40 may move between (and not including) the first and second positions so that the control line 20 does not become sealed and flow is not interrupted.

It is also understood that the counter-force provided by the springs 50*a*, 50*b* should equal the pressure at which an operator wishes to seal the control line 20 (in case of a pressure spike or blow out). Thus, the shuttle valve 30 can be rated at different pressures, depending on the safety requirements of the operator. Moreover, the counter-forces provided by the two springs 50*a*, 50*b* may be different so that different forces are accepted in each direction prior to sealing.

Thus, the shuttle valve 30 serves to seal flow in either the downhole or uphole direction in the case of pressure spikes (including blow-outs) while allowing bi-directional flow during normal control line operation.

FIGS. 2A-2D illustrate another embodiment of a shuttle valve 30. Like the embodiment illustrated in FIG. 1, the shuttle valve 30 in this embodiment is located in a housing 32 that is in fluid communication on both ends 34, 36 with the control line 20. The housing 30 can be annular in shape such that it also acts as a joint between two tubing pieces 22*a*, 22*b* (not shown). The control line 20 can be attached to each housing end 34, 36 by way of threads or clamps (not shown). In another embodiment (not shown), the shuttle valve 30 is located directly within the control line 20.

A shuttle 40 is located within the housing 32 and is slidingly disposed within a cavity 56 formed in the housing 32. In one embodiment, the shuttle 40 is sealingly slidingly disposed within the cavity 56, wherein at least one and in some cases two dynamic seals 62 are disposed in grooves 64 around the shuttle. The seals 62 enable the sealing and sliding movement of the shuttle 40 against the cavity surfaces. The shuttle also includes a passageway 66 therethrough from one shuttle end 68*a* to the other shuttle end 68*b*. A rupture disk 70 is disposed across the passageway (such as but not necessarily adjacent shuttle end 68*b*) to prevent fluid communication across the passageway 66 until the rupture pressure of the rupture disk 70 is exceeded.

In another embodiment, the shuttle 40 does not include seals 62 thereon. Instead, while the shuttle 40 still slides within cavity 56, a small space exists between the shuttle 40 and the cavity wall allowing some fluid flow therethrough. In this embodiment, however, the space is not large enough to prevent the transfer of pressure across shuttle 40, as will be described below.

Two fluids F1, F2 are present in the control line 20. Fluid F1 is present on one side of the shuttle 40, and fluid F2 is present on the other side of the shuttle 40. The fluids F1, F2 do not mix unless the rupture disk 70 is broken. The fluids F1, F2 may be the same or different fluids.

Figure 2A:
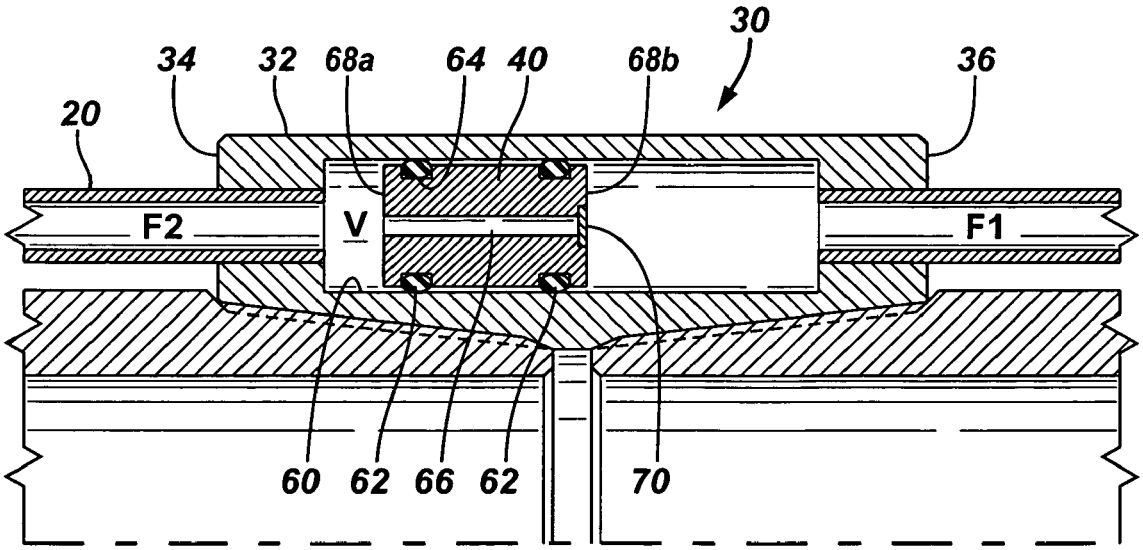
FIGS. 2A-2D are illustrations of another embodiment of the shuttle valve.
Figure 2B:
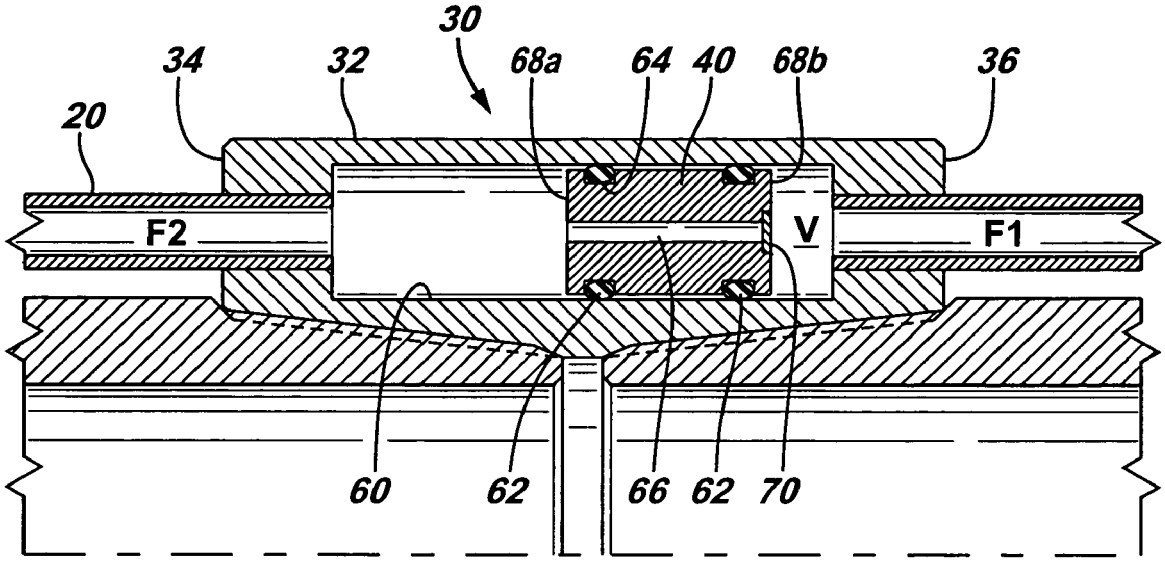

In normal operating circumstances, shuttle 40 has two positions. In the first position as shown in FIG. 2A, the pressure of fluid F1 is greater than that of fluid F2 causing the shuttle 40 to move in the direction of end 68*a*. In the second position as shown in FIG. 2B, the pressure of fluid F2 is greater than that of fluid F1 causing the shuttle 40 to move in the direction of end 68*b*.

In one embodiment, a volume V is left in the cavity adjacent the shuttle end 68*a* when the shuttle 40 is in the first position. Likewise, a volume V is left in the cavity adjacent the shuttle end 68*b* when the shuttle is in the second position. For the first position as well as the second position, the volumes V are included for purposes of safety so that further movement of shuttle 40 is possible in either direction in case of an abrupt increase in pressure from either direction.

In operation and assuming that shuttle end 68*b* is proximate the uphole direction and shuttle end 68*a* is proximate the downhole direction (although the shuttle valve 30 can function if the opposite is true), an operator may wish to use control line 20 to communicate with a tool downhole. In so doing, the operator may pressurize the fluid F1 in control line 20 from the surface. Once the pressure in fluid F1 is greater than the pressure of fluid F2, the shuttle 40 moves in the downhole direction to the first position shown in FIG. 2A. Subsequently, or instead of pressuring the fluid F1, an operator may decrease the pressure of fluid F1. Once the pressure in fluid F1 is less than the pressure of fluid F2, the shuttle 40 moves in the uphole direction to the second position shown in FIG. 2B.

Figure 2C:
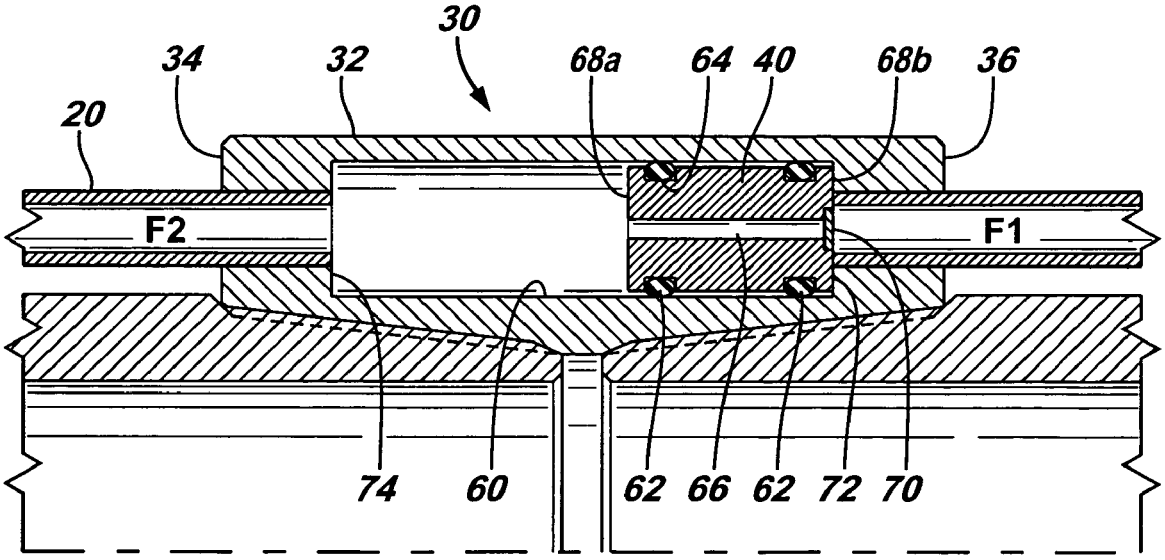

FIG. 2C shows the case when there is a blow-out or a pressure spike from the downhole location and such blow-out or pressure spike is transmitted through the control line 20. If this occurs, such increased pressure within fluid F2 moves shuttle 40 in the uphole direction and past the second position until the shuttle end 68*b* abuts the uphole surface 72 of cavity 60. Thus, shuttle valve 30 seals a blow-out or pressure spike from the downhole direction. In this embodiment, the rupture disk 70 remains intact as it can only be ruptured by increased pressure from the uphole direction.

Figure 2D:
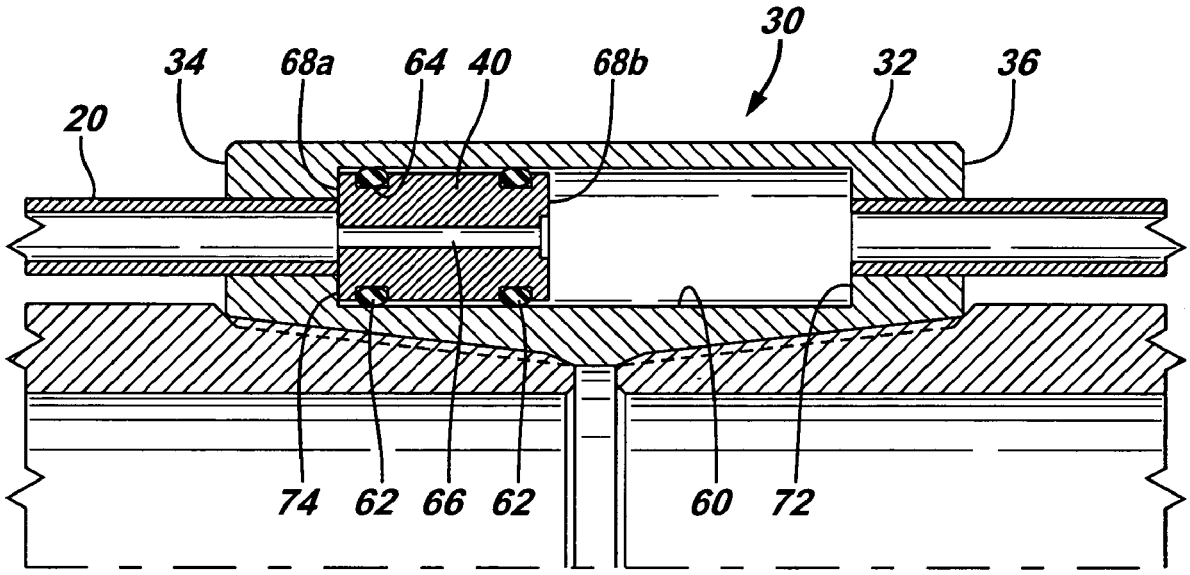

FIG. 2D shows the case when an operator wishes to establish fluid communication across shuttle 40 through passageway 66 by rupturing rupture disk 70. An operator may desire to do this, for instance, if there is a malfunction in the shuttle valve 30 or there is a leak in the control line 20 and the operator still desires to control the relevant downhole tool. To establish fluid communication across shuttle 40, the pressure of fluid F1 is increased by the operator to a pressure above the rupture pressure of the disk 70. Although FIG. 2D shows the shuttle end 68*a* abutting the downhole surface 74 of cavity 60, it is understood that the rupture of rupture disk 70 may occur anywhere in between this position and the first position as illustrated in FIG. 2A (the exact location depends on the pressure of fluid F2 and the rupture pressure of rupture disk 70). Once the pressure of fluid F1 is above the rupture pressure of disk 70, the disk 70 ruptures thereby allowing fluid communication across the shuttle 40 through the passageway 66. This enables operators to communicate directly with the downhole tool through the control line 20.

Thus, the shuttle valve 30 of FIGS. 2A-2D serves to prevent blow-outs while allowing bi-directional flow during normal control line operation.

Figure 3:
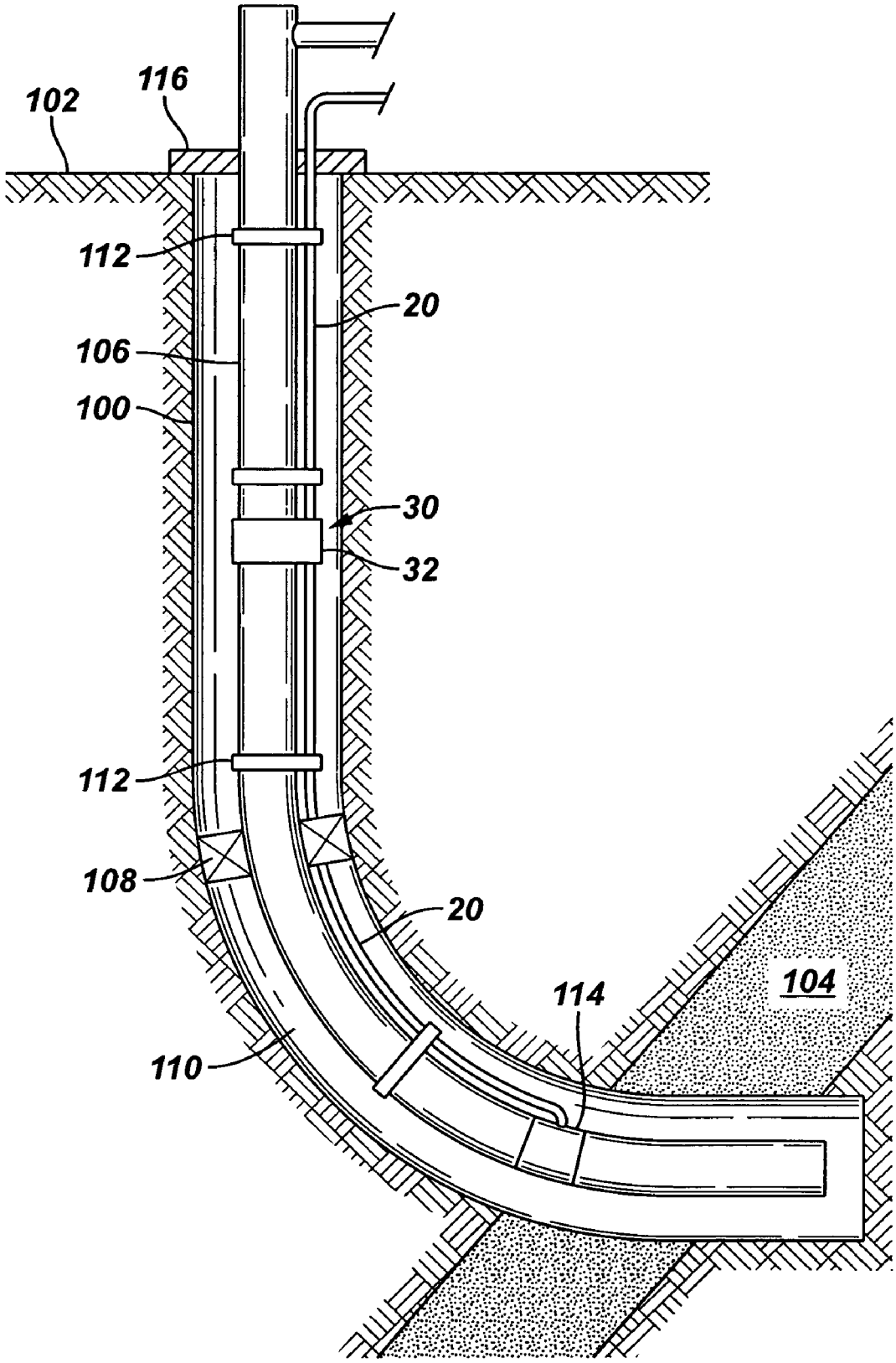
FIG. 3 is an illustration of the shuttle valve and control line incorporated in a subterranean wellbore completion.

FIG. 3 shows the shuttle valve 30 and the control line 20 incorporated in a subterranean wellbore completion. A wellbore 100 extends from the surface 102 in the downhole direction. The wellbore 100 may be a land wellbore wherein the surface 102 is the earth's surface or a subsea wellbore wherein the surface 102 is the ocean bottom. The wellbore 100 may or may not be cased and typically intersects at least one hydrocarbon formation 104. Tubing 106, such as production or coiled tubing, extends within the wellbore 100 from the surface 102 to a downhole location that is in fluid communication with the formation 104. A packer 108 may isolate the annulus 110 therebelow ensuring all fluids below packer 108 are either being produced within the tubing 106 (if the wellbore 100 is a producer) or being injected into the formation 104 (if the wellbore 100 is an injector).

Control line 20 is deployed adjacent tubing 106 and is held in place in relation to tubing 106 by way of clamps 112. Control line 20 is deployed through packer 108 (such as through a by-pass port) and to downhole tool 114. As previously disclosed, the fluid(s) in the control line 20 are used to operate downhole tool 114 by increasing, decreasing, and/or fluctuating the pressure. The downhole tool 114 can comprise any pressure-operated downhole tool, including valves, packers, and perforating guns. In the embodiment shown in FIG. 3, the downhole tool 114 can comprise a sliding sleeve valve enabling fluid communication between formation 114 and the interior of tubing 106.

The shuttle valve 30 and housing 32 of shuttle valve 30 can be incorporated at any point along the control line 20. As previously disclosed, the housing 32 can be an annular joint used to attach two tubing pieces together.

In operation, an operator wishing to activate downhole tool 114 (such as by opening or closing the valve) need only perform the necessary pressurization or depressurization in control line 20 to enable such activation. The shuttle valve 30 will function as previously disclosed in these normal operating circumstances.

If a blow-out or downhole pressure spike occurs, the wellhead 116 and safety valve 114 will typically automatically operate to seal the annulus 110 and the tubing 112. In the present invention, the shuttle valve 30 also operates to seal the interior of the control line 20 as previously disclosed.

Figure 4:
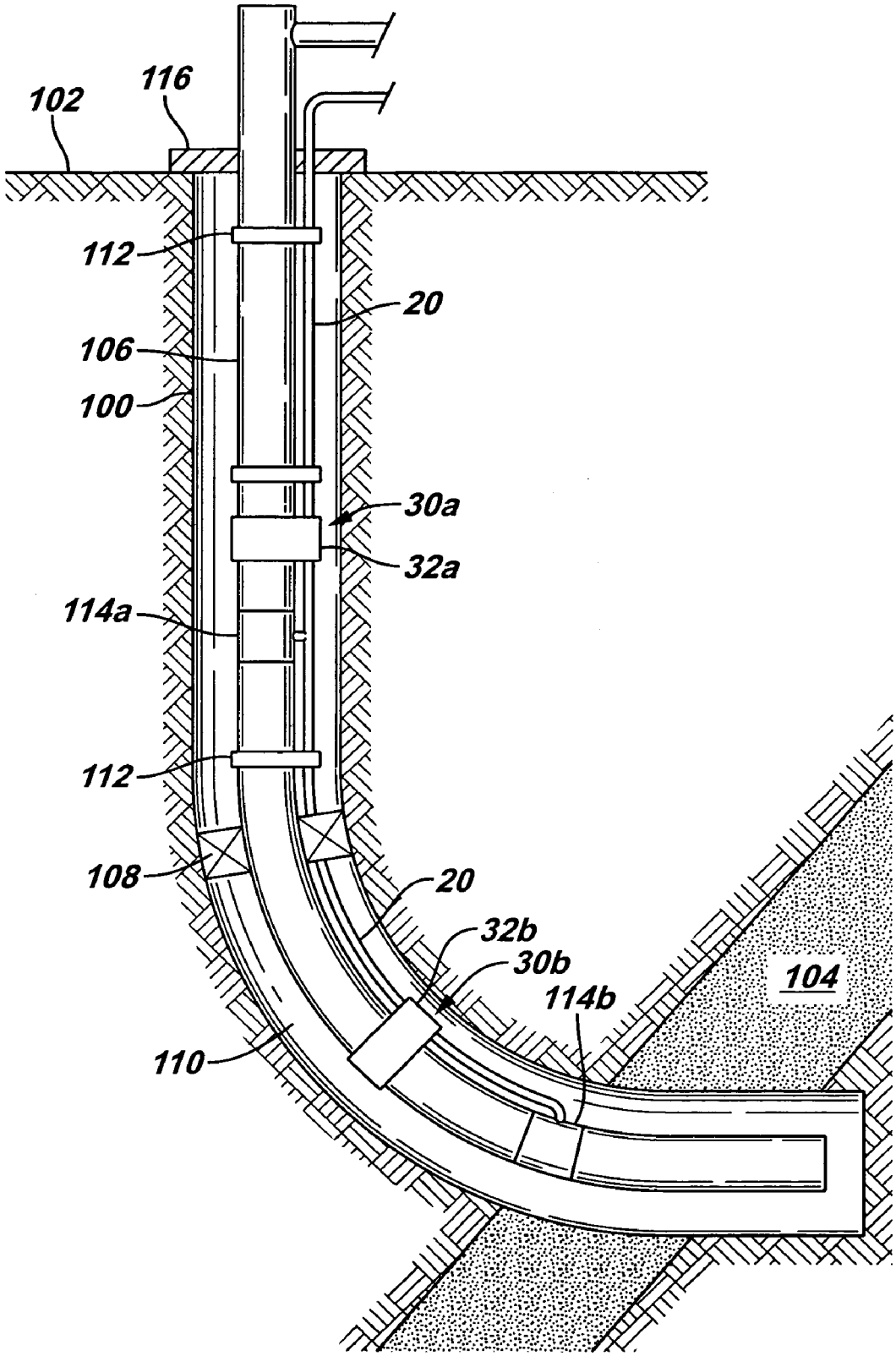
FIG. 4 is an illustration of at least two shuttle valves with one control line incorporated in a subterranean wellbore completion.

FIG. 4 is similar to FIG. 3, except that at least two shuttle valves 30*a*, 30*b* as shown in FIG. 1 are incorporated with a single control line 20 in the wellbore 100. In this embodiment, the springs (50 in FIG. 1) are rated so that each of the downhole tools 114 may be selectively activated. For instance, the springs 50 of both valves 30*a* and 30*b* may be rated above the activation pressure of downhole tool 114*b*. Therefore, an operator can pressurize control line 20 and activate downhole tool 114*b* without sealing any of the valves 30*a*, 30*b*. As long as the activation pressure of downhole tool 114*a* is greater than that of downhole tool 114*b*, downhole tool 114*a* would not be activated based solely on the activation of downhole tool 114*b*. Or, the activation pressure of downhole tool 114*a* may be rated above the rating of the spring 50 of valve 30*b* but below the rating of the spring 50 of valve 30*a*. Therefore, an operator can pressurize control line 20 to the activation pressure of downhole tool 114*a*, which would seal valve 30*b* (because its spring 50 rating is below the tool 114*a* activation pressure) and not seal valve 30*a* (because its spring 50 rating is above the tool 114*a* activation pressure). In this manner, downhole tool 114*a* may be selectively activated.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

The invention claimed is:

1. A method for preventing blow-outs in a wellbore including a control line, the method comprising:

sealing a tubing in the wellbore with a safety valve in case of a blow-out;

sealing an annulus between the tubing and the wellbore with a wellhead in case of a blow-out;

sealing the control line with a valve in case of a blow-out, the sealing being accomplished automatically with the pressure of the blow-out; and transferring pressure across the valve and control line from both a downhole and an uphole direction during normal operating conditions.

2. The method of claim 1, wherein the transferring step comprises shuttling the valve in the uphole and downhole directions depending on the direction of the higher pressure.

3. The method of claim 2, further comprising biasing the shuttling movement of the valve in at least one direction.

4. The method of claim 3, further comprising biasing the shuttling movement of the valve in both the downhole and uphole directions.

5. The method of claim 4, wherein the biasing step comprises providing two springs, each spring providing a counter-force to one of the sliding movement directions of the shuttle.

6. The method of claim 4, wherein the biasing step comprises providing excess volume in a cavity that houses the shuttle.

7. The method of claim 1, further comprising functionally connecting the control line to a downhole tool.

8. The method of claim 7, further comprising hydraulically actuating the downhole tool through the control line.

9. The method of claim 1, further comprising providing a shuttle sealingly slidingly disposed within a cavity in a housing.

10. The method of claim 9, wherein the shuttle prevents fluid communication in the control line.

11. The method of claim 10, further comprising rupturing a disk in the shuttle to enable fluid communication across the shuttle through a passageway in the shuttle.

12. A method for preventing blow-outs in a wellbore including a control line, the method comprising:

sealing the control line with a valve in case of a blow-out by utilizing the pressure resulting from the blow-out; and transferring pressure through the valve and control line from both a downhole and an uphole direction during normal operating conditions.

13. A system for preventing blow-outs in a wellbore including a control line, the system comprising:

at least two valves adapted to seal the control line in case of a blow-out, wherein each of the valves enables pressure transfer through the control line from both a downhole and an uphole direction during normal operating conditions;

wherein the control line is used to hydraulically actuate at least two downhole tool; and wherein the at least two valves are adapted to enable the selective actuation of the lease two downhole tools.

14. The system of claim 13, wherein:

each of the valves includes at least one spring providing a counterforce to a movement of the valve; and wherein the springs of the valves are rated to enable the selective actuation of the at least two downhole tools.

* * * * *